US005127362A

United States Patent [19]

Iwatsu et al.

[11] Patent Number: 5,127,362

[45] Date of Patent: Jul. 7, 1992

[54] LIQUID COATING DEVICE

[75] Inventors: Haruo Iwatsu, Shichijo; Yasuhiro Sakamoto; Junro Iwakiri, voth of Kumamoto, all of Japan

[73] Assignees: Tokyo Electron Limited, Tokyo; Tokyo Electron Kyushu Limited, Kumamoto, both of Japan

[21] Appl. No.: 525,681

[22] Filed: May 21, 1990

[30] Foreign Application Priority Data

May 22, 1989 [JP] Japan ..... 1-128194
Jun. 5, 1989 [JP] Japan ..... 1-142395

[51] Int. Cl.[5] ..... B05B 1/24

[52] U.S. Cl. ..... 118/667; 118/666; 118/712; 118/52; 118/56; 427/240

[58] Field of Search ..... 118/52, 56, 58, 64, 118/320, 666, 667, 688, 712; 427/240, 9, 10

[56] References Cited

U.S. PATENT DOCUMENTS 2,699,080 10/1987 Finney ..... 118/666
4,738,219 4/1988 Fujisawa ..... 118/666
4,932,353 6/1990 Kawata et al. ..... 118/52

FOREIGN PATENT DOCUMENTS 61-90331 5/1986 Japan ..... 118/52
61-137322 6/1986 Japan ..... 118/712
62-214621 9/1987 Japan ..... 118/52
63-70424 3/1988 Japan ..... 118/666
63-119531 5/1988 Japan ..... 118/52
1-272118 10/1989 Japan ..... 118/667

*Primary Examiner*—Michael G. Wityshyn
*Assistant Examiner*—Todd J. Burns
*Attorney, Agent, or Firm*—Oblon, Spivak, McClelland, Maier & Neustadt

[57] ABSTRACT

A liquid coating device for coating a solution on a substrate to form a film includes a chuck for rotatably supporting the substrate, a nozzle for supplying the solution on the substrate, a heater provided in the nozzle for changing a temperature of the solution, a sensor for measuring a temperature of an ambient atmosphere of the substrate, and a controller for controlling the heater according the measured temperature. Thus, a solution having a temperature corresponding to the temperature of the ambient atmosphere is supplied from the nozzle to the substrate.

8 Claims, 1 Drawing Sheet

LIQUID COATING DEVICE

BACKGROUND OF THE INVENTION

1. Field of the Invention

The present invention relates to a liquid coating device for forming a thin film.

2. Description of the Related Art

A liquid coating device to be described below is conventionally known.

That is, in order to obtain a desired pattern of a thin film in a wafer processing step in the manufacture of semiconductor integrated circuits, a mask is formed by a thin metal film or the like having a desired pattern formed on a photosensitive resist film coated on a wafer, and the photosensitive resist is exposed and developed. In this resist coating step, coating films must be formed in same uniform thicknesses in order to form a high-quality semiconductors. A spin coater is often used for this purpose. The spin coater drops a resist from a nozzle located above a wafer by using a mechanism for supplying a predetermined amount of a resist solution and rotates a chuck which chucks the wafer by suction or the like at a high speed in a cup surrounding the chuck, thereby performing coating.

It is found that, in this coater, the film thickness of a resist coating film depends on the viscosity and the temperature of a resist solution, the temperature and the rotational speed of a wafer, and environmental factors such as ambient temperature and humidity. Therefore, these parameters are controlled by maintaining the processing conditions in the cup constant to ensure precision of the film thickness. Since, however, temperature/humidity adjusting equipment for obtaining the predetermined conditions is expensive and the parameters have mutual relationships with each other, it is difficult to set optimal conditions.

SUMMARY OF THE INVENTION

It is an object of the present invention to provide a liquid coating device which can coat a film having a uniform film thickness and is inexpensive.

In order to achieve the above object, in a resist coating device of the present invention for coating a solution on a substrate to be rotated, the temperature of a coating solution, the rotational speed of the substrate, and/or the temperature of the substrate are controlled by at least one of the temperature and humidity of a spin coating atmosphere.

According to the liquid coating device of the present invention, at least one of the temperature of a coating solution, e.g., the temperature of a nozzle for supplying the solution, and the rotational speed and temperature of a substrate, e.g., the rotational speed and temperature of a chuck is or are controlled in accordance with the environmental temperature and humidity during spin coating of the coating solution onto the substrate, thereby obtaining a uniform film thickness. If the environmental temperature is high, the thickness of a coated film, e.g., a resist film is increased on a wafer peripheral portion and decreased on its central portion, for instance. If the environmental temperature is low, since the resist is not easily extended, the film thickness is increased on the central portion and decreased on the peripheral portion.

If the environmental humidity is optimal with respect to the resist or wafer temperature, a film having an optimal film thickness can be formed. If, however, the humidity is high, the film thickness is decreased. If the humidity is low, the film thickness is increased.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWING

The accompanying drawing, which is incorporated in and constitutes a part of the specification, illustrates a presently preferred embodiment of the invention and, together with the general description given above and the detailed description of the preferred embodiment given below, serves to explain the principles of the invention.

DETAILED DESCRIPTION OF THE PREFERRED EMBODIMENT

An embodiment in which a liquid coating device of the present invention is applied to a resist coating device will be described below with reference to the accompanying drawing.

Figure 1:
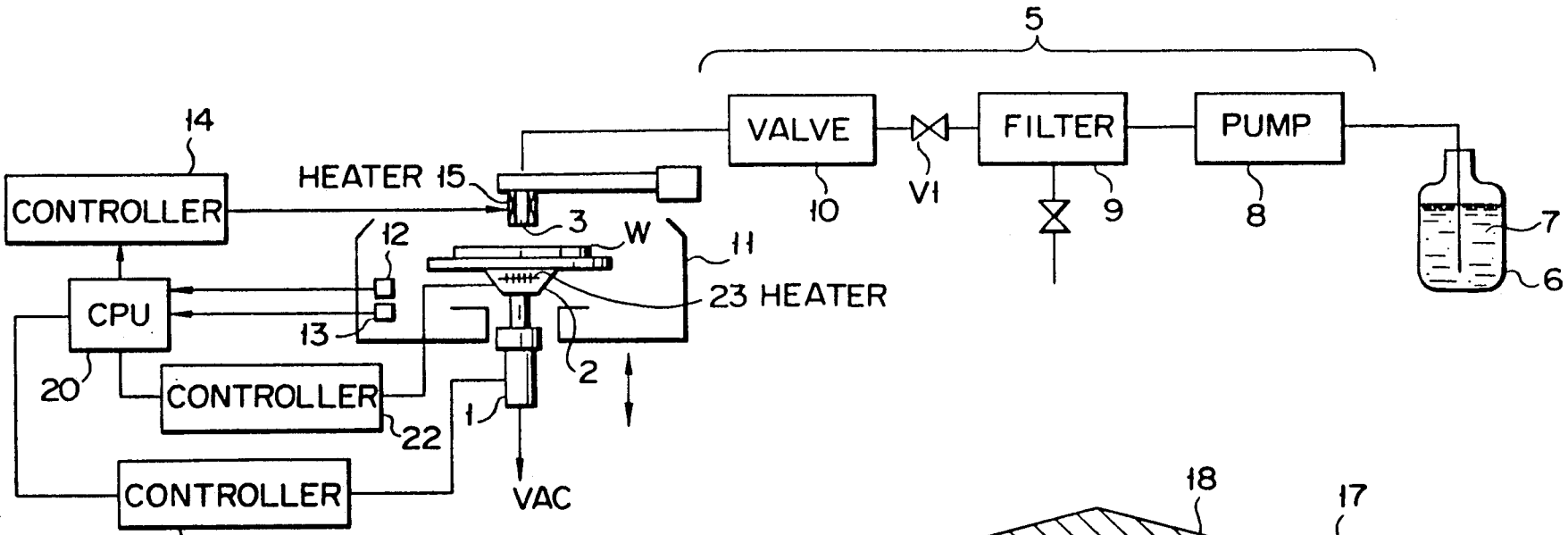
FIG. 1 is a block diagram showing a spin coating device according to an embodiment of the present invention.

A resist coating device shown in FIG. 1 has a chuck 2 having a disc-like upper surface for fixing a wafer W thereon by vacuum suction or the like and fixed to a rotating shaft of a motor (rotary drive mechanism) 1. An injection nozzle (nozzle) 3 is provided above a central portion of the disc of the chuck 2. If dispensing from the nozzle 3 is not executed for a predetermined time period at, e.g., the beginning of a new lot, a resist solution may be kept in contact with air at the distal end of the nozzle 3 for a long time and solidified thereat. In order to prevent this, dummy dispensing must be performed. Since the nozzle 3 is moved from the portion above to outside the chuck 2 in order to perform dummy dispensing, the nozzle 3 can be freely moved in the horizontal direction. A resist supply system 5 as a resist supply unit connected to the nozzle 3 comprises a pump 8 such as a bellows pump for supplying a desired predetermined amount of a resist 7 contained in a resist vessel 6, a filter 9, a valve $V_1$ to be opened/closed in association with the pump 8, and a suck back valve 10 for sucking the resist 7 back to the nozzle 3 after a predetermined amount of the resist is injected from the nozzle 3, thereby preventing drooling or solidification of the resist 7.

As a processing vessel to prevent scattering of the resist to outside the device upon resist coating, a cup 11 is provided to surround the chuck 2. The cup 11 can vertically move as indicated by an arrow shown in FIG. 1. The cup 11 moves downward from a position shown in FIG. 1 to expose the chuck 2 upon loading/unloading of the wafer W, thereby facilitating loading/unloading. The cup 11 includes a temperature sensor 12 and a humidity sensor 13 for measuring the environmental factors, i.e., the temperature and the humidity in the cup 11. A drain pipe, an exhaust pipe, and the like (none of which are shown) are connected to a lower portion of the cup 11.

The resist coating device of the present invention further comprises a heater 15 as temperature adjusting means of the nozzle 3. The heater 15 is cylindrically formed so as to uniformly heat the inner circumferential surface of the nozzle 3. A temperature adjustment controller 14 operates or controls the heater 15 in accordance with a signal generated by a CPU 20 in response to input signals supplied from the temperature and humidity sensors 12 and 13, thereby controlling the temperature of a coating solution. The temperature adjusting means is not limited to the heater but may be a structure in which the nozzle 3 is constituted by a double pipe so that a circulating flow path of temperature adjusting water is formed around a resist flow path. That is, any structure can be used as long as the temperature of a resist dispensed from the nozzle can be controlled. The resist viscosity can be changed by adjusting the resist temperature by heating control performed by the temperature adjusting means (heater 15).

A rotational speed controller 21 as rotational speed adjusting means for the chuck 2 supplies a drive signal to the motor 1 in accordance with a signal generated by the CPU 20 in response to input signals supplied from the temperature and humidity sensors 12 and 13. When the rotational speed of the motor 1 is adjusted, the chuck 2 is simultaneously adjusted because it is rotated in synchronism with the motor 1. The CPU activates a heating unit controller 22 as driving means for a heating unit 23 embedded in the chuck 2 in response to input signals supplied from the temperature and humidity sensors 12 and 13.

A method of forming a resist film having a uniform thickness by using the resist coating device having the above arrangement will be described below.

Figure 2:
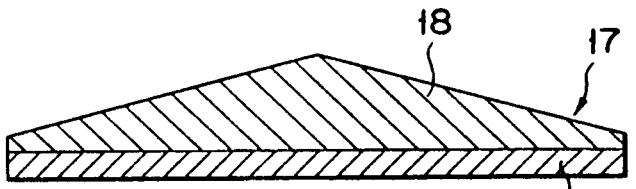
FIGS. 2 to 4 are sectional views each for explaining the thickness of a film formed on a substrate.
Figure 3:
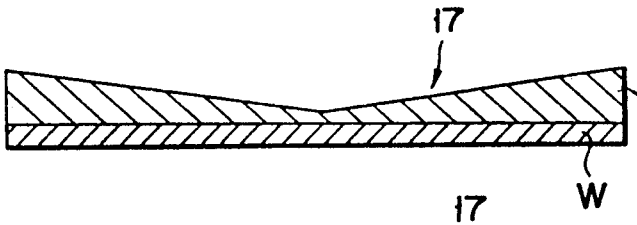
Figure 4:
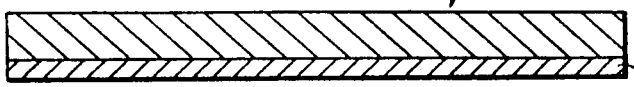

When a wafer W is chucked and supported on the chuck 2 by a loading/unloading mechanism (not shown), the cup 11 moves upward as shown in FIG. 1. The wafer W chucked on the chuck 2 is rotated in synchronism with rotation of the motor 1 at a predetermined rotational speed, e.g., 1,000 rotations/sec. for a predetermined period and then rotated at a higher rotational speed of, e.g., 4,000 rotations/sec. for another predetermined period. A predetermined amount of the resist 7 is supplied from the resist supply system 5 via a conduit and dropped on the center of the wafer W rotated at a high speed. If the temperature in the cup 11 is lower than an optimal temperature for resist film formation, the dropped resist 7 forms a resist film 17 having a large film thickness on a central portion 18 of the wafer W as shown in a sectional view of FIG. 2. In this case, however, in accordance with a relationship, between the resist viscosity (temperature) and at least one of the temperature and humidity in the cup 11, which is input beforehand by a signal generated by the CPU 20, the temperature adjustment controller 14 operates the heater 15 in response to an output from the temperature sensor 12 to increase the resist temperature so that a film is formed to have a small thickness on the central portion and a large thickness on the peripheral portion. As a result, nonuniformity of the film thickness between the central and peripheral portions is cancelled, and a resist film 17 having a uniform film thickness can be formed, as shown FIG. 4. If the temperature in the cup 11 is higher than the optimal temperature, a resist film 17 having a large film thickness on a peripheral portion 19 of the wafer W is formed, as shown in FIG. 3. In this case, however, the temperature adjustment controller 14 stops the heater 15 to decrease the resist temperature in the manner opposite to that described above so that a film is formed to have a large thickness on the central portion and a small thickness on the peripheral portion. As a result, the nonuniformity of the film thickness is similarly cancelled, and a resist film 17 having a uniform film thickness can be formed, as shown in FIG. 4. Similar to the temperature if the humidity changes during the coating process, the humidity sensor 13 detects this humidity change and, in accordance with a relationship between the resist viscosity and the humidity in the cup 11, which is input beforehand by a signal generated by the CPU 20, the temperature adjustment controller 14 operates the heater 15, adjusting the temperature of the resist solution to thereby form resist films having a predetermined film thickness. Also, as the humidity becomes higher than an optimal value of, e.g., 35%, the thickness of a formed resist film is increased such that the film thickness changes by several tens A as the humidity changes by 1%. The humidity in the cup 11 changes by about 30% to 40%. When the humidity sensor 13 detects this change, the rotational speed controller 21 compares the detected temperature with a relationship, between the temperature in the cup 11 and the rotational speed of the wafer W, which is input beforehand by a signal generated by the CPU in response to an output from the temperature sensor 12. The rotational speed controller 21 then increases the rotational speed of the motor 1 to be higher than a normal rotational speed, thereby decreasing the film thickness to cancel the film thickness variation, so that the following films may have a suitable thickness. If the temperature of the wafer W is higher than the optimal temperature for resist film formation, a resist film having a smaller film thickness than a target film thickness is formed. In this case, however, the rotational speed controller 21 decreases the rotational speed of the motor 1 to be lower than the normal rotation speed in the manner opposite to that described above to cancel the film thickness variation, thereby forming the following resist films having a predetermined target film thickness. A resist film has a film thickness of about 1 μm, and an error of several tens Å is produoed in the film thickness as the wafer temperature changes by 1° in a conventional device. According to the device of the present invention, however, a film having a predetermined film thickness can be formed by changing the rotational speed. Similar to the above temperature change, if the humidity changes during a coating process, the humidity sensor 13 detects this humidity change and the rotational speed controller 21 compares the detected humidity with a relationship, between the humidity in the cup 11 and the rotational speed of the wafer W, which is input beforehand. The rotational speed controller 21 then changes the rotational speed of the motor 1, thereby forming resist films having a predetermined film thickness.

When the CPU supplies a signal to the heating unit controller 22 to drive the heating unit 23 such as a nichrome wire embedded in the chuck 2 in response to signals supplied from the temperature and humidity sensors 12 and 13, the temperatures of the chuck 2 and the wafer W become equal to each other, thereby enabling more precise control in association with the relationship with the rotational speed. Note that the heating unit is not limited to that of the above embodiment but may be any conventional unit.

In the aforementioned process, the temperature and humidity of the spin coating atmosphere are measured for a predetermined period before the dripping of the resist. The temperature of the chuck 2 is adjusted to the measured temperature. The heater 15 is controlled according to the type and viscosity of the resist, the rotational speed of the chuck 2 and the measured temperature, so that the resist has a suitable temperature. Under this condition, trial spin coating is performed, and the uniformity of the formed film is measured. If the uniformity is not satisfied, the process is repeated until a desired uniformity is obtained. Next, such a rotational speed of the chuck 2 is determined by the type and viscosity of the resist, the temperature and humidity in the spin coating atmosphere, as is suitable for forming a film of a desired thickness. The trial spin coating is repeated until the film come to have a desired thickness. After the pre-coating process, proper coating is carried out, forming uniform films having the same, desired thickness. During the coating process, the resist temperature, the chuck temperature and/or the chuck rotation speed may be controlled to obtain desired film, in accordance with the varying temperature and/or humidity in the atmosphere.

In the above embodiment, the present invention is applied to a resist coating device. However, the present invention can be similarly applied to a coating device for a developing solution or a coating device for a magnetic film as long as the device is used for coating.

Additional advantages and modifications will readily occur to those skilled in the art. Therefore, the invention in its broader aspects is not limited to the specific details, and a representative device, shown and described. Accordingly, various modifications may be made without departing from the spirit or scope of the general inventive concept as defined by the appended claims and their equivalents.

What is claimed is:

1. A liquid coating device for coating a solution on a substrate to form a film, comprising:

means for supporting a substrate;

means for supplying a solution on said substrate;

means for rotating the supporting means with said substrate thereon;

means for measuring a temperature and a humidity of an ambient atmosphere surrounding said substrate;

means for comparing the measured temperature and humidity with reference data and controlling said rotating means in accordance with comparison data derived from said comparing means and said reference data.

2. A liquid coating device for coating a solution on a substrate to form a film, comprising:

means for rotatably supporting a substrate;

means for supplying a solution on said substrate;

means for changing a temperature of said substrate;

means for measuring a temperature and a humidity of an ambient atmosphere surrounding said substrate; and means for comparing the measured temperature and humidity with reference data and controlling said temperature changing means in accordance with comparison data derived from said comparing means and said reference data.

3. A liquid coating device for coating a solution on a substrate to form a film, comprising:

means for rotatably supporting a substrate;

means for supplying a solution on said substrate;

means for heating the solution to be supplied to said substrate;

means for measuring a temperature and a humidity of an ambient atmosphere surrounding said substrate; and means for comparign the measured temperature and humidity with reference data and controlling said heating means in accordance with comparison data derived from said comparing means and said reference data.

4. A photosensitive resist coating device for applying a resist solution on a semiconductor wafer to form a film coating, comprising:

means for supporting a semiconductor wafer;

means for rotating the supporting means with the wafer;

a cup for enclosing the supporting means and the wafer mounted thereon;

means for supplying drops of a predetermined amount of resist solution and applying said drops so that each drop is attached onto said wafer when the wafer is rotated by the rotating means;

means for continuously measuring a temperature and a humidity of an ambient atmosphere in the cup during the supply of drops, and outputting a measurement signal; and means for continuously comparing the measurement signal with reference data and controlling the temperature of the solution and the temperature of said wafer in accordance with comparison data derived from said measurement signal and said reference data.

5. A photosensitive resist coating device for applying a resist solution on a semiconductor wafer to form a film coating, comprising:

means for rotatably supporting a semiconductor wafer;

means for supplying a resist solution and applying said solution on said wafer;

means for heating the resist solution to be supplied to said wafer;

a cup for enclosing the wafer;

means for measuring a temperature and a humidity of an ambient atmosphere in the cup; and means for comparing the measured temperature and humidity with reference data and controlling said heating means in accordance with comparison data derived from said comparing means and said reference data.

6. A photosensitive resist coating device for applying a resist solution on a semiconductor wafer to form a film coating, comprising:

means for supporting a semiconductor wafer;

means for rotating the supporting means with the wafer;

a cup for enclosing the supporting means and the wafer mounted thereon;

means for supplying drops of a predetermined amount of the resist solution and applying said drops so that each drop is attached onto said wafer when the wafer is rotated by the rotating means;

measuring means for continuously measuring a temperature and a humidity of an ambient atmosphere in the cup during the supply of drops, and outputting a measurement signal; and means for continuously comapring the measurement signal with reference data and controlling the rotation and the temperature of said wafer in accordance with comparison data derived from said measurement signal and said reference data.

7. A photosensitive resist coating device for applying a resist solution on a semiconductor wafer to form a film coating, comprising:

means for supporting a semiconductor wafer;

means for rotating the supporting means with the wafer;

a cup for enclosing the supporting means and the wafer mounted thereon;

means for supplying drops of a predetermined amount of the resist solution and applying said drops so that each drop is attached onto said wafer when the wafer is rotated by the rotating means;

means for continuously measuring a temperature and a humidity of an ambient atmosphere in the cup during the supply of drops, and outputting a measurement signal; and means for continuously comparing the measurement signal with reference data and controlling the temperature of the solution and the rotation of said wafer in accordance with comparison data derived from said measurement signal and said reference data.

8. A device according to claim 7, wherein said supplying means includes a nozzle through which the drops are injected onto the wafer, a vessel for storing the resist solution, means for supplying a given amount of resist solution contained in the vessel to the nozzle, and a suck back valve for sucking the resist solution back to the nozzle after a predetermined amount of resist solution is injected from the nozzle to prevent the injection of unwanted drops of the resist solution onto the wafer.

* * * * *